US007752762B2

(12) United States Patent
King, IV et al.

(10) Patent No.: US 7,752,762 B2
(45) Date of Patent: Jul. 13, 2010

(54) DOOR STRIKE AND LATCH TEMPLATE

(75) Inventors: Joseph Calvin King, IV, Jackson, TN (US); Gregory Kevin Griffin, Humboldt, TN (US)

(73) Assignee: Black & Decker Inc., Newark, DE (US)

( * ) Notice: Subject to any disclaimer, the term of this patent is extended or adjusted under 35 U.S.C. 154(b) by 486 days.

(21) Appl. No.: 11/729,463

(22) Filed: Mar. 29, 2007

(65) Prior Publication Data

US 2008/0052999 A1 Mar. 6, 2008

Related U.S. Application Data

(60) Provisional application No. 60/841,321, filed on Aug. 31, 2006, provisional application No. 60/901,398, filed on Feb. 15, 2007.

(51) Int. Cl.
*E05B 17/06* (2006.01)
*E04F 21/00* (2006.01)

(52) U.S. Cl. ..... 33/197; 33/562; 144/27

(58) Field of Classification Search ..... 33/194, 33/197, 528, 613, 626–628, 636–638, 520, 33/526, 527, 641–645, 562, 563, 565, 566, 33/DIG. 10; 144/27, 144.51
See application file for complete search history.

(56) References Cited

U.S. PATENT DOCUMENTS

| | | | |
|---|---|---|---|
| 2,585,470 | A | 2/1952 | Josephson |
| 2,821,028 | A | 1/1958 | Godfrey |
| 2,869,245 | A | 1/1959 | Bork |
| 2,927,378 | A | 3/1960 | Godfrey et al. |
| 3,053,293 | A | 9/1962 | Nissen |
| 3,062,075 | A | 11/1962 | Saha |
| 3,206,861 | A | 9/1965 | Damijonaitis et al. |
| 3,559,704 | A | 2/1971 | Thompson |
| 3,738,013 | A | 6/1973 | Gregory |
| 3,789,892 | A | 2/1974 | Converse et al. |
| 3,954,344 | A | 5/1976 | Nakama |
| 4,042,202 | A | 8/1977 | Molinari |
| 4,058,902 | A | 11/1977 | Hall |
| 4,231,675 | A | 11/1980 | Scozzafava |

(Continued)

OTHER PUBLICATIONS

European Search Report for EP Patent Application No. 07105295.5, mailed Mar. 4, 2009, 4 pages.

*Primary Examiner*—Amy Cohen Johnson
(74) *Attorney, Agent, or Firm*—Brake Hughes Bellermann LLP

(57) ABSTRACT

A lock template includes an elongated body member that defines a substantially rectangular first opening having a first length and a first width and an elongated first member. The elongated first member is configured to be removably-inserted into first end recesses of the body such that the first member is located at least partially within the first opening. The first member, when inserted in the first end recesses of the body, defines a wall of a second opening having a length substantially equal to the first length and a width smaller than the first width. The second opening is configured to guide a cutting instrument to form a mortise for a lock component in a passageway component. When the first member is inserted into the first end recesses a longitudinal central axis of the first insert member is offset from a central axis between the first end recesses of the body.

20 Claims, 14 Drawing Sheets

U.S. PATENT DOCUMENTS

| | | | |
|---|---|---|---|
| 4,262,394 | A | 4/1981 | Wright |
| 4,400,886 | A | 8/1983 | Bindschatel |
| 4,501,308 | A | 2/1985 | Sherman |
| 4,565,228 | A | 1/1986 | Ponce |
| 4,787,430 | A | 11/1988 | Miyamoto |
| D306,250 | S | 2/1990 | Kyrklund |
| 4,984,613 | A | 1/1991 | Szeto et al. |
| 5,029,394 | A | 7/1991 | Carey |
| 5,042,543 | A | 8/1991 | Carey |
| D335,089 | S | 4/1993 | Grubelnik |
| 5,279,343 | A | 1/1994 | Woods |
| D346,337 | S | 4/1994 | Carey |
| 5,367,783 | A | 11/1994 | Nygren |
| D356,513 | S | 3/1995 | Burkholder, II |
| D395,012 | S | 6/1998 | Shouse |
| D395,246 | S | 6/1998 | Carey |
| D415,046 | S | 10/1999 | Carey |
| 6,076,575 | A | 6/2000 | Harkness |
| 6,182,371 | B1 | 2/2001 | Newman |
| 6,834,415 | B2 | 12/2004 | Almestad |
| 2006/0272166 | A1 | 12/2006 | Adkins et al. |
| 2007/0283528 | A1 * | 12/2007 | McDaniel et al. ..... 16/221 |

* cited by examiner

DOOR STRIKE AND LATCH TEMPLATE

CROSS-REFERENCE TO RELATED APPLICATIONS

This application claims priority under 35 U.S.C. §119 to: (i) U.S. Provisional Application No. 60/841,321, filed on Aug. 31, 2006, and titled, "DOOR STRIKE AND LATCH TEMPLATE"; and (ii) U.S. Provisional Application No. 60/901,398, filed on Feb. 15, 2007, and titled, "DOOR STRIKE AND LATCH TEMPLATE," both of which are incorporated herein by reference in their entirety.

TECHNICAL FIELD

This description relates to a door strike and latch template, and, in particular, to a door strike and latch template used to guide a cutting instrument to create recesses in a door and/or door frame for installation of a strike plate and/or a latch plate.

BACKGROUND

Installation of a door or window lock generally involves cutting a recess (also known as a mortise) in the edge of the door or window to accommodate at least a portion of the lock within the door or window and cutting a corresponding recess in the door or window jamb to accommodate a mortise that receives and engages with a locking mechanism (e.g., a bolt) of the lock. For example, the mortise in the door or window may be cut to accommodate a lock bolt and/or the latch plate of the lock, and the mortise in the jamb may be cut to accommodate a strike plate that defines the recess that receives the bolt of the lock.

Doors and windows have various thicknesses, and locks are offered in a wide variety of shapes and sizes. Therefore, it may be necessary for a woodworker to cut mortises having a wide variety of shapes and sizes in the doors and windows and in the jambs with which the locks operate. In practice, it may be difficult for either professional or amateur woodworkers to cut properly sized and shaped mortises, particularly in a repeatable or reliable manner. For example, if a woodworker attempts to position a door lock and the corresponding mortise in the door jamb by measuring associated distances, then small measurement errors may cause an undesirable and noticeable offset between the door lock and the mortise in the jamb.

Consequently, strike and latch plate templates have been developed that seek to provide woodworkers with fast, easy, reliable techniques for positioning door and window locks and the corresponding mortises in the door and window jambs. Generally, a latch plate template is used to guide a cutting instrument, e.g., a router, to form a recess for a latch plate in an edge surface of a door, and a strike plate template is used to form a corresponding mortise in the door jamb. That is, a door strike plate template may be used to form a first mortise in the surface of the door jamb, and a door latch plate template may be used to form a second mortise in the facing edge surface of the door, so that the door lock and the jamb mortise, respectively, may engage to close and unclose or lock or unlock the door.

SUMMARY

In a general aspect, a lock template includes an elongated body member that defines a substantially rectangular first opening having a first length and a first width and an elongated first member. The elongated first member is configured to be removably-inserted into first end recesses of the body such that the first member is located at least partially within the first opening. The first member, when inserted in the first end recesses of the body, defines a wall of a second opening having a length substantially equal to the first length and a width smaller than the first width. The second opening is configured to guide a cutting instrument to form a mortise for a lock component in a passageway component. When the first member is inserted into the first end recesses a longitudinal central axis of the first insert member is offset from a central axis between the first end recesses of the body.

Implementations can include one or more of the following features. For example, the first member can be adapted to be inserted into the first end recesses of the body in a first position such that the wall of the second opening defines a second width of the second opening, and the first member can be adapted to be inserted into the first end recesses of the body in a second position such that the wall of the second opening defines a third width of the second opening, where the third width is less than the second width.

In the first position, a top end of first member can be inserted into a top recess of the body and a bottom end of the first member can be inserted into a bottom end recess of the body, while in the second position, the top end of first member can be inserted into the bottom end recess of the body and the bottom end of the first member can be inserted into the top end recess of the body.

The body can include a top surface upon which dimensions corresponding to the second and third width are indicated, and the first member can include an indication that refers to the dimension of the second width when the first member is located in the first position and that refers to the dimension of the third width when the first member is located in the second position. The passageway component can be a door or a window and the lock component is a latch plate, or a strike plate.

The lock template can also include an elongated second insert member configured to be removably-inserted into second end recesses of the body such that the second member is located at least partially within the first opening and such that a longitudinal central axis of the second insert member is substantially parallel to the longitudinal central axis of the first member when the first member is inserted into the first end recesses. In this implementation, when the second member is inserted into the second end recesses the second member can define a wall of the second opening.

The first and second members can be adapted to be inserted into the first and second end recesses of the body in a first configuration in which the offset central axes of the first and second members are offset away from each other and thereby define a second width of the second opening, and the first and second members can be adapted to be inserted into the first and second end recesses of the body in a second configuration in which the offset central axes of the first and second members are offset towards each other and thereby define a third width of the second opening that is less than the second width. In the first configuration top ends of the first and second members can be inserted into top recesses of the body and bottom ends of the first and second members can be inserted into bottom end recesses of the body, and in the second configuration top ends of the first and second members can be inserted into bottom recesses of the body and bottom ends of the first and second members can be inserted into top end recesses of the body. Alternatively, in the first configuration a top end of the first member can be inserted into a top first end recess of the body and a bottom end of the first member can be inserted into a bottom first end recess of the body and a top end of the second member can be inserted into a top second end recess of the body and a bottom end of the second member can be inserted into a bottom second end recess of the body. In this alternative, in the second configuration a top end of the first member can be inserted into a top second end recess of the body and a bottom end of the first member can be inserted into a bottom second end recess of the body and a top end of the second member can be inserted into a top first end recess of the body and a bottom end of the second member is inserted into a bottom first end recess of the body.

The body can include a top surface upon which dimensions corresponding to the second and third width are indicated, and the first and second members can include indications that refer to the dimension of the second width when located in the first configuration and that refer to the dimension of the third width when located in the second configuration.

When inserted into the second end recesses the second insert member can define a third opening having third width less than the first width, and the third opening can be configured to guide a cutting instrument to form a mortise for a lock component.

The body can include at least one alignment portion having a plurality of apertures configured to receive an alignment pin, where locations of the plurality of apertures on the body correspond to a plurality of door thicknesses, and the body can include an alignment surface configured to abut against a surface of the passageway component when forming the mortise in the passageway component. A selected one of the plurality of apertures can be configured to receive the alignment pin therethrough, and the alignment pin can extend beyond the alignment surface when the alignment surface abuts the surface of the passageway component. A selected one of the plurality of apertures can be configured to receive the alignment pin therethrough, and the alignment pin can abut against the door during formation of the mortise in the passageway component.

The alignment pin can include a plurality of radially-extending tabs, and the plurality of apertures can each include a corresponding plurality of slots to receive the plurality of tabs, and the plurality of slots can each include an internal surface. Then, the alignment pin can be configured for locking into place within a selected one of the plurality of apertures by insertion of the tabs into the corresponding slots and subsequent rotation of the alignment pin to thereby position the tabs within the slot and in contact with the internal surface. The body can include a plurality of indicia associated with the plurality of apertures, each of the indicia specifying a door thickness associated with the associated aperture.

The body can include a center line marking positioned to designate a midpoint along the length of the first opening.

In another general aspect, a lock template can include a body having a first opening having a width equal to a first width and a second opening having a width equal to a second width, where each opening is configured to guide a cutting instrument to form a mortise for a lock component in a passageway component. The lock template also includes a first insert member and a second insert member. The first insert member is adapted to be removably coupled to the body to define the width of the first opening to be a third width less than the first width. The second insert member is adapted to be removably coupled to the body at a predetermined location of the body, such that a first face of the second insert member faces toward a side wall of the second opening to define the width of the second opening to be a fourth width less than the second width, or to be removably coupled to the body at the predetermined location of the body, such that a first face of the second insert member faces away from the side wall of the second opening to define the width of the second opening to be a fifth width less than the second width but greater than the fourth width.

In addition to the particular implementations described above, other implementations can include one or more of the following features. For example, the first opening can be adapted to form a mortise for a strike plate, and the second opening can be adapted to form a mortise for a latch plate. The first opening can be adapted to form a mortise for a strike plate having a tongue when the first insert is removed from the body and can be adapted to form a mortise without a tongue when the insert is coupled to the body.

Other advantages and features will be apparent from the description, the drawings, and the claims.

DETAILED DESCRIPTION

Figure 1:
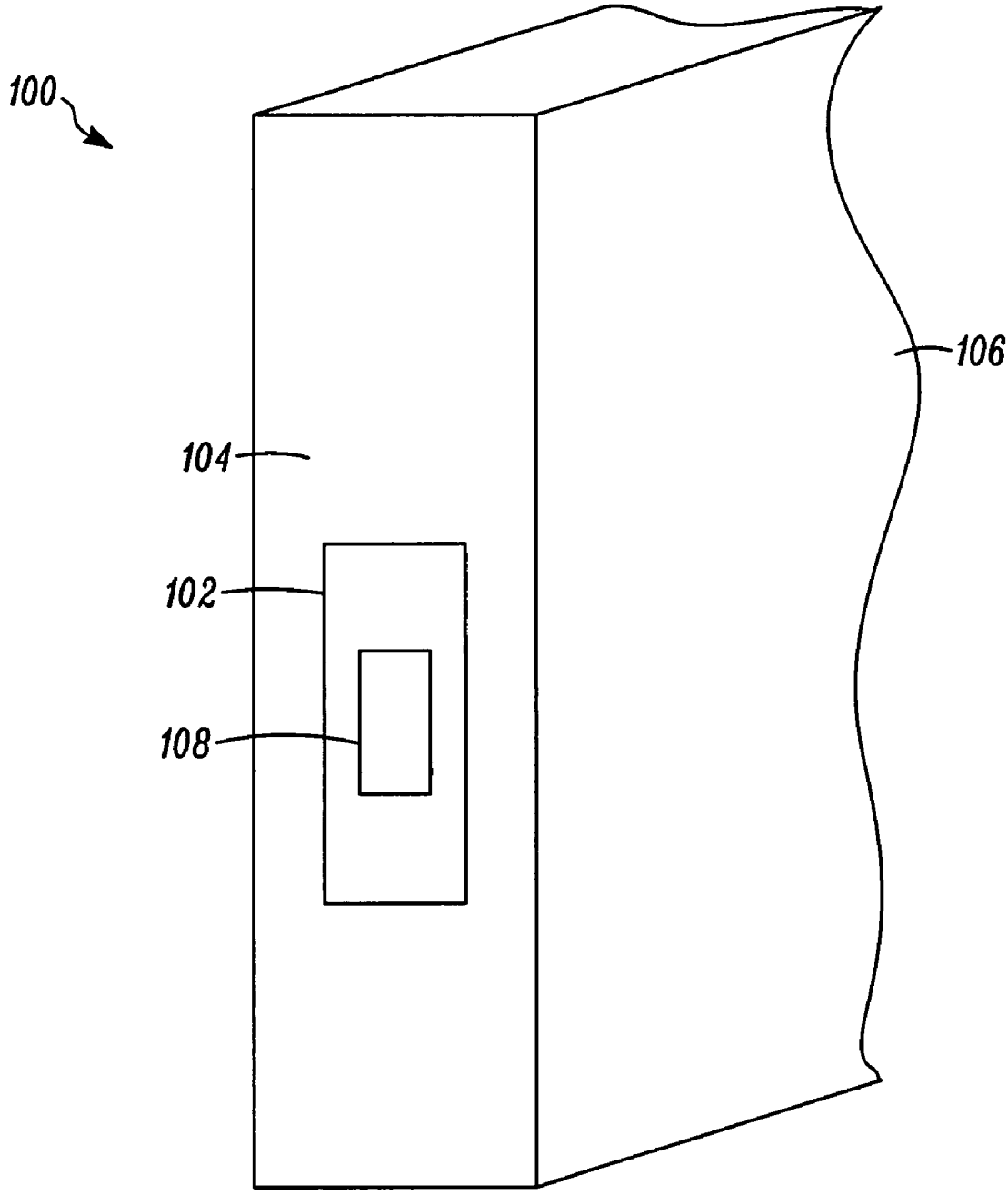
FIG. 1 is a schematic perspective view of a door that includes a latch plate.

FIG. 1 is a schematic perspective view of a door 100 that includes a latch plate 102. The latch plate 102 is mounted on the edge surface 104 of the door 100. In one implementation, the latch plate 102 can be preferably located in the middle of the edge surface 104, equidistant between a front surface 106 of the door and a back surface of the door. The latch plate 102 has a non-infinitesimal thickness and therefore is recessed into and mounted in a mortise cut into the edge surface of the door, such that a surface of the latch plate is preferably flush with the edge surface 104 of the door 100.

The latch plate 102 includes an aperture 108 that is aligned with an underlying lock mortise cut into the door though which a bolt of a door lock (not shown) can pass. The bolt of the door lock may engage with a mortise cut into a jamb in a door frame upon which the door is hung, such that the door may be securely closed in the door frame when the bolt engages with the mortise in the jamb. The jamb of the door frame may include a strike plate that can be mounted within a strike plate mortise cut into the jamb, such that a top surface of the strike plate is flush with the surface of the jamb, as described in more detail below.

In the example of FIG. 1, the door 100 and the latch plate 102 are provided to explain and illustrate a function and operation of a template for cutting a mortise for the latch plate in the door. Consequently, the illustration of the door 100 and the door frame 102 is simplified and abbreviated for these purposes, and so it should be understood that many additional or alternative features of the door 100 may be included. For example, the door 100 may include an opening mechanism (e.g., a door knob) and a lock that are not shown in the example of FIG. 1.

Figure 2A:
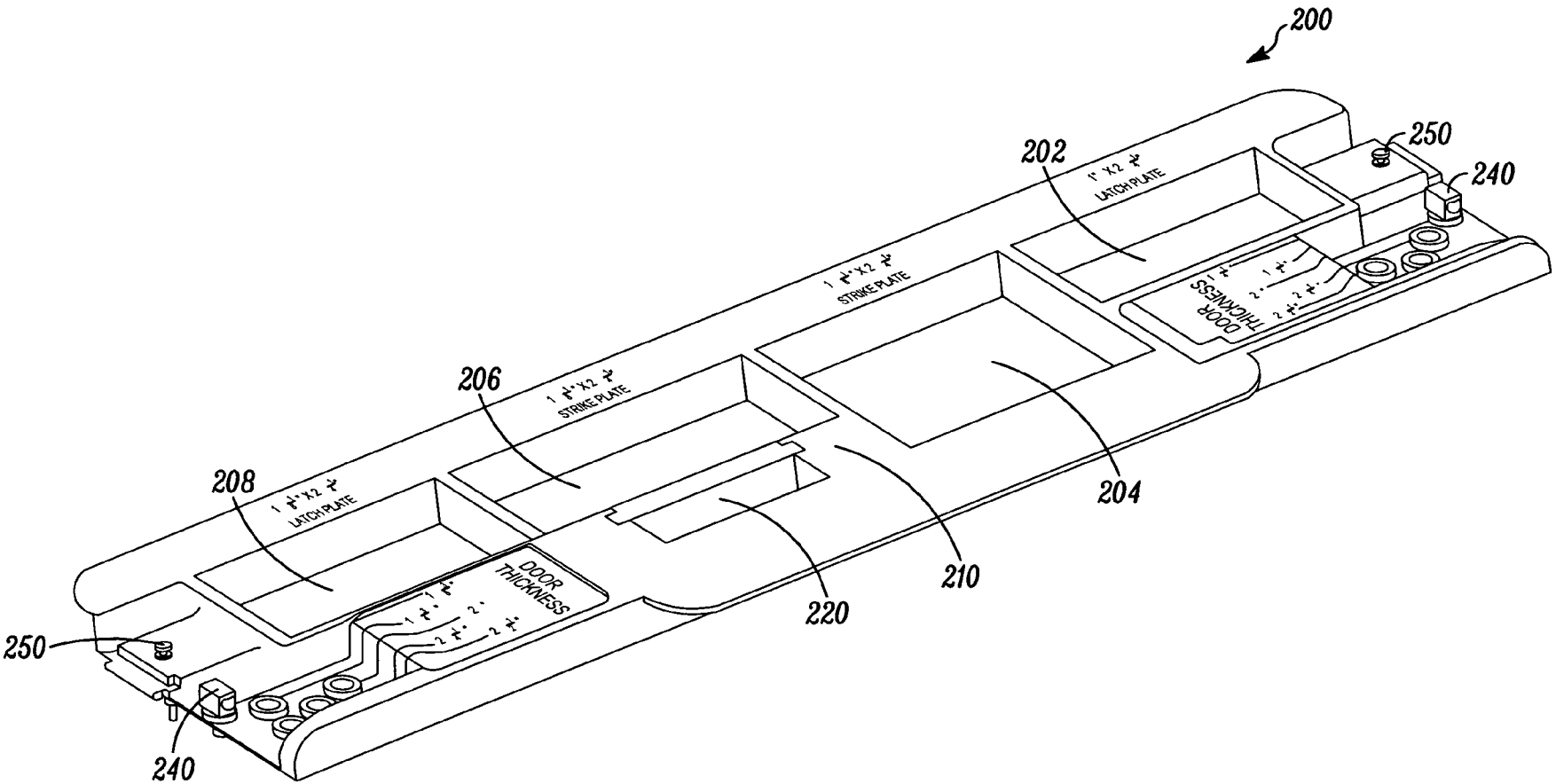
FIG. 2A is a schematic perspective view of a latch and strike plate template for cutting mortises for latch and strike plates of various shapes and sizes.

FIG. 2A is a schematic perspective view of a latch and strike plate template 200 for cutting mortises for latch and strike plates of various shapes and sizes. The latch and strike plates can be used for securing structures in various passageways (e.g., doorways and windows). For simplicity, the use of latch and strike plates is described herein primarily with reference to doors, doorways, and door frames. However, other passageways and passageway components (e.g., windows and window frames) are also contemplated. The template 200 can include a top surface 210 and multiple openings 202, 204, 206, and 208 of different shapes and sizes that can be used to transfer predetermined patterns of latch plate mortises to doors or to transfer predetermined patterns of strike plate mortises to door jambs. For example, the template 200 can be aligned with a door 100 into which a mortise for a latch plate 102 is to be cut, such that an opening 202 is located over a central portion of the edge surface 104 of the door 100. The template 200 then can be secured in place (e.g., by temporarily nailing the template 200 to the door 100), and a cutting instrument (e.g., a router) can trace the pattern of the opening 202 to cut the pattern into the edge surface 104 of the door 100.

Figure 2B:
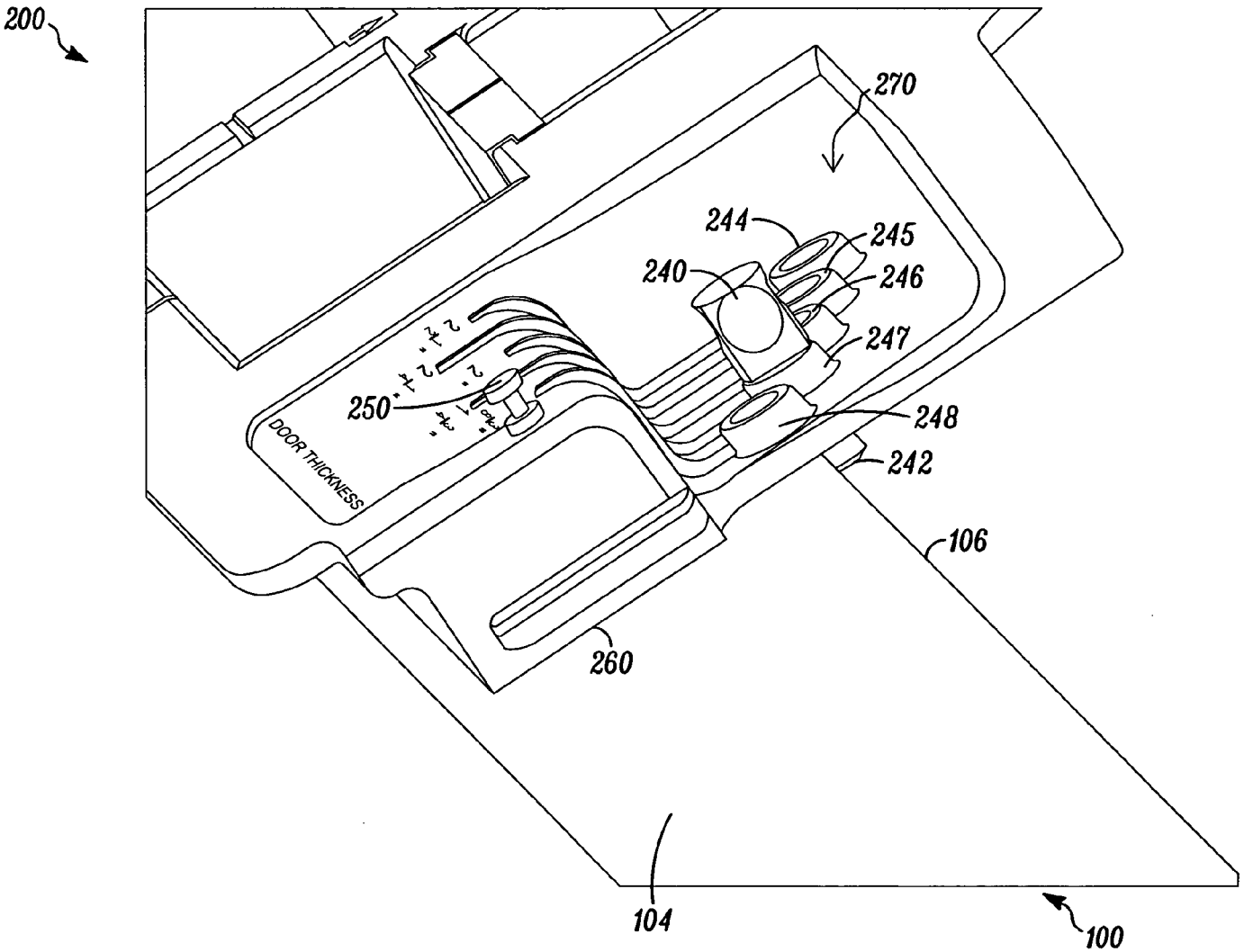
FIG. 2B is a schematic perspective view of a latch and strike plate template positioned on a door for cutting a mortise for a latch and strike plates.

For example, as shown in FIG. 2B, the template 200 can be positioned against a door 100 by placing an alignment surface 260 on the underside of the template 200 on the edge surface 104 of a door 100 and sliding the template toward the door until bottom portions 242 of two pins 240 located at either end of the template 200 contact a front surface 106 of the door. In this position, the openings 202, 204, 206, and 208 of the template are located over the side edge 104 of the door 100. The pins 240 can by removably inserted into one of several apertures 244, 245, 246, 247, and 248, which are located within an alignment portion 270 of the template 200. Each of the apertures 244, 245, 246, 247, and 248 is located a different distance from a longitudinal centerline of the openings 202, 204, 206, and 208. Thus, when the pins extend through an aperture 244, 245, 246, 247, and 248 beyond the alignment surface 260 and contact the front surface 106 of the door, the distance of the centerline of the openings 202-208 to the front surface 106 of the door depends on which hole the pins 240 are placed in. Holes are located at predetermined distances from the centerline of the openings 202-208, such that the openings can be placed over the center of the edge surface 104 of doors that have known thicknesses. For example, the pins can be placed in hole 247 to center an opening 202, 204, 206, or 208 over the edge surface 104 of a door having a thickness of 1¾". Pins 240 are placed in holes 244 to center an opening over the side edge 104 of a 2½" thick door. Pins 240 are placed in holes 245 to center an opening over the side edge 104 of a 2¼" thick door. Pins 240 are placed in holes 246 to center an opening over the side edge 104 of a 2" thick door. Pins 240 are placed in holes 248 to center an opening over the side edge 104 of a 1⅜" thick door.

Once the template 200 is positioned such that openings are in their desired positions with respect to the edge surface 104 and front surface 106 of the door, the template can be secured in place temporarily by driving nails 250 through locating holes 252 at either end of the template. The holes 252 are not shown explicitly in FIG. 2A or 2B but are evident in FIGS. 9A, 11, and 12A described below. After the mortise has been cut with the aid of the template 200, the nails 250 can be withdrawn from the door 100 and the template 200 can be removed from the door 100.

Figure 3:
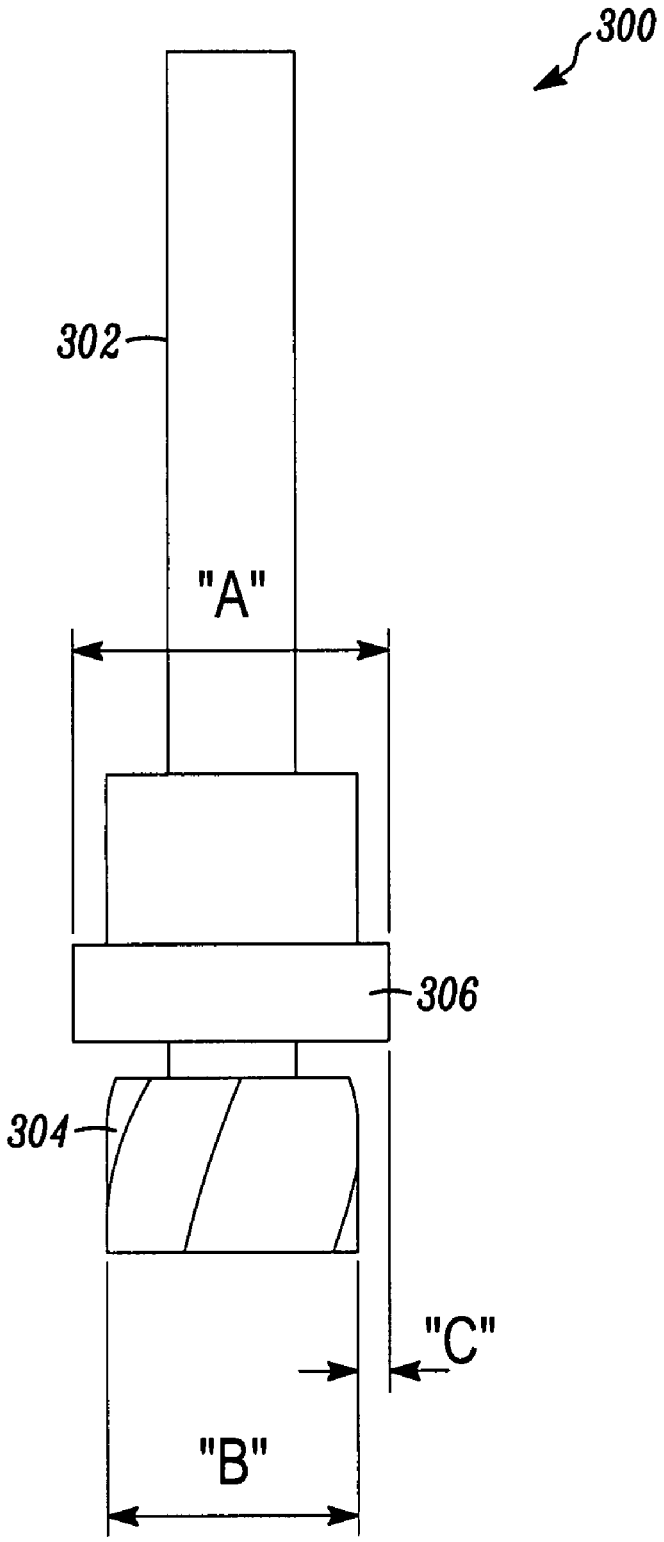
FIG. 3 is a schematic cutaway side view of a portion of a router for cutting mortises.

FIG. 3 is a schematic cutaway side view of a portion of a router 300. The router 300 can include a shaft 302 that is rotated by a motor, and the shaft can be coupled to a bit or a blade 304 that cuts into the wood of the door or jamb to create the mortise. The router 300 can include a bearing 306 through which the shaft 302 passes and which locates the shaft and the bit 304. Thus, the bit 304 and the bearing 306 of the router can be positioned within an opening 202, 204, 206, or 208 of a template 200 that is aligned with a side edge 104 of a door, and while the bit 304 rotates it can trace out the pattern of the opening to 202, 204, 206, or 208 cut a mortise in the door having a size and shape that approximates the size and shape of the opening 202, 204, 206, or 208 in the template 200.

The bit 304 may have a diameter, "B", that is slightly smaller than the diameter, "A", of the bearing 306. For example, in one implementation, the bit may have a diameter of about 0.500 inches and the bearing may have a diameter of about 0.625 inches. Therefore, in this implementation, when the bearing 306 abuts the inside walls of the opening 202, 204, 206, or 208 as the bit 304 moves within the opening to trace the pattern of the opening, the bit will not cut wood that is directly under the inside walls of the opening. Rather, the bit 304 may approach no closer than a distance, "C", equal to one-half the difference in the diameter of the bearing diameter and the bit diameter (e.g., 0.0625 inches, or $1/16^{th}$ of an inch, in the implementation shown in FIG. 3) from the inside wall of the opening. Therefore, if an opening 202 in the template 200 has a width of 2.625 inches, a mortise having a width of 2.500 includes would be cut when using the opening to guide the router bit having a bit diameter of 0.500 inches and a bearing having diameter of 0.625 inches. The depth of the mortise can be controlled by controlling the depth of the bit 304 in the router 300. For example, a bottom plate (not shown) of the router 300 may rest on the top surface 210 of the template 200 when the router is used to cur the mortise, and the bottom plate may mechanically limit the depth to which the bit can 304 cut into the wood of the door 100.

Figure 4A:
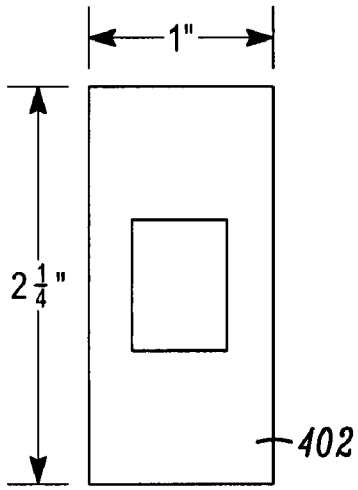
FIGS. 4A and 4B are schematic end views of two latch plates having different widths.
Figure 4B:
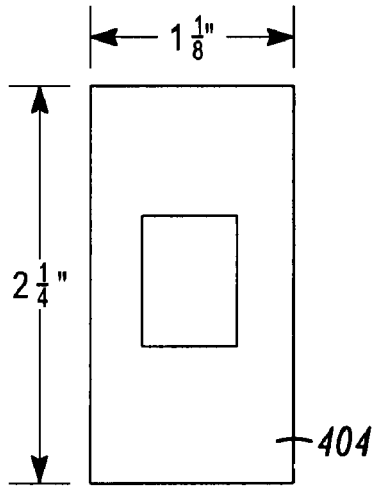

Referring again to FIG. 2A, the template may include multiple openings 202, 204, 206, and 208 because door locks and door latch plates having a wide variety of shapes and sizes may be used in a door. For example, FIGS. 4A and 4B are schematic end views of two latch plates having different widths. The width of the latch plate 402 of FIG. 4A may be 1.000 inches, while the width of the latch plate 404 depicted in FIG. 4B may be 1.125 inches. Opening 202 can be used to cut the mortise for the 1 inch wide latch plate 402, and opening 208 can be used to cut the mortise for the 1.125 inch wide latch plate. Opening 204 can be used to cut a mortise for a rectangular strike plate having a predetermined length and width. For example, the opening 204 can be used to cut a mortise that has a length of 2.25 inches for a strike plate that is 2.25 inches long. The opening 204 can have a width of 1.75 inches, to form a mortise with the same width. If the mortise extends off the edge of the door jamb, then the mortise can be used with a strike plate that can extend off the edge of the door jamb and that, therefore, can be wider than 1.75 inches. Opening 206 can be used to cut mortises have two different shapes and sizes, depending on the position of a removable gate 220. As shown in FIG. 2A, when the gate 220 is positioned with the body of the template, the opening can be used to cut a rectangular mortise for a strike plate or a latch plate having a predetermined length and width (e.g., a length of 2.75 and a width of 1.125). When the gate 220 is removed from the body of the template 200, the opening 206 can be used to cut a "T" shaped mortise for a strike plate having a predetermined length (e.g., 2.75 inches) and a tongue portion that extends from the rectangular portion that would be defined if the gate 200 were positioned within the body of the template 200. The T-shaped mortise can be used, for example, for a strike plate that extends off the ends of a door jamb.

Although templates can be designed having a plurality of different-sized openings that each correspond to a differently-sized strike and latch plate, the number of openings in a template that are necessary to create a desired number of differently-sized mortises can be reduced by utilizing removable inserts, such as the gate 220 shown in FIG. 2A. Thus, the size of a single opening in a template may be quickly and a reliably changed with simple inserts to provide appropriate patterns for the differently-sized latch plates 402 and 404. For example, with the gate 220 in position in template 200, opening 206 can have a smaller, rectangular shape, while when the gate 220 is removed the opening 206 can have a larger, "T" shape.

Figure 5:
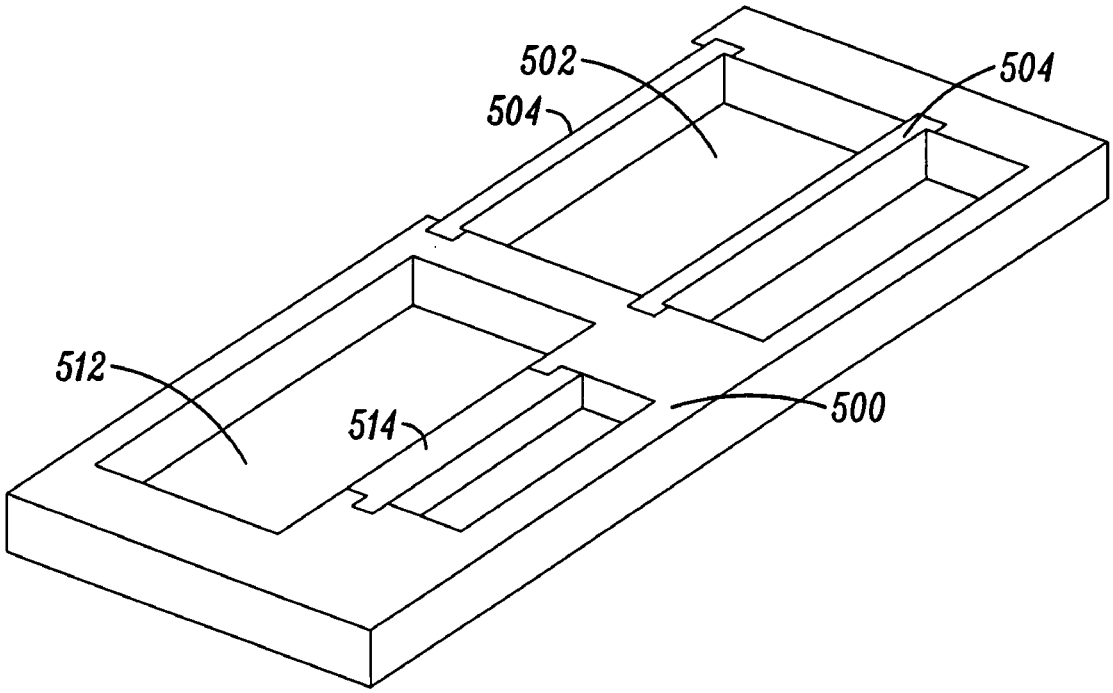
FIG. 5 is a schematic perspective view of a two-opening template that can be used to make five different-sized mortise patterns.

One example of how removable inserts can be used to vary the size and shaped of openings in a template is shown in FIG. 5, which is a schematic perspective view of a two-opening template that can be used to make five different-sized mortise patterns. A first opening 502 can be defined by the template body 500 and two removable inserts 504 having offset flanges to allow the width of the opening 502 to assume at least three different widths, as explained in more detail below. A second opening 512 can be defined by the body 500 and by a single removable insert 514 that detachable-engages with the template body 500. With the insert 514 engaged, a relatively rectangular opening is defined that can be used to cut a mortise for a strike plate or latch plate in a door jamb. When the insert 514 is removed, the shape of the second opening 512 is defined by the body 500 to be a fat "T" shape and can be used to cut a mortise used for a strike plate that includes a tongue that extends to the edge or beyond the edge of a door jamb.

Figure 6B:
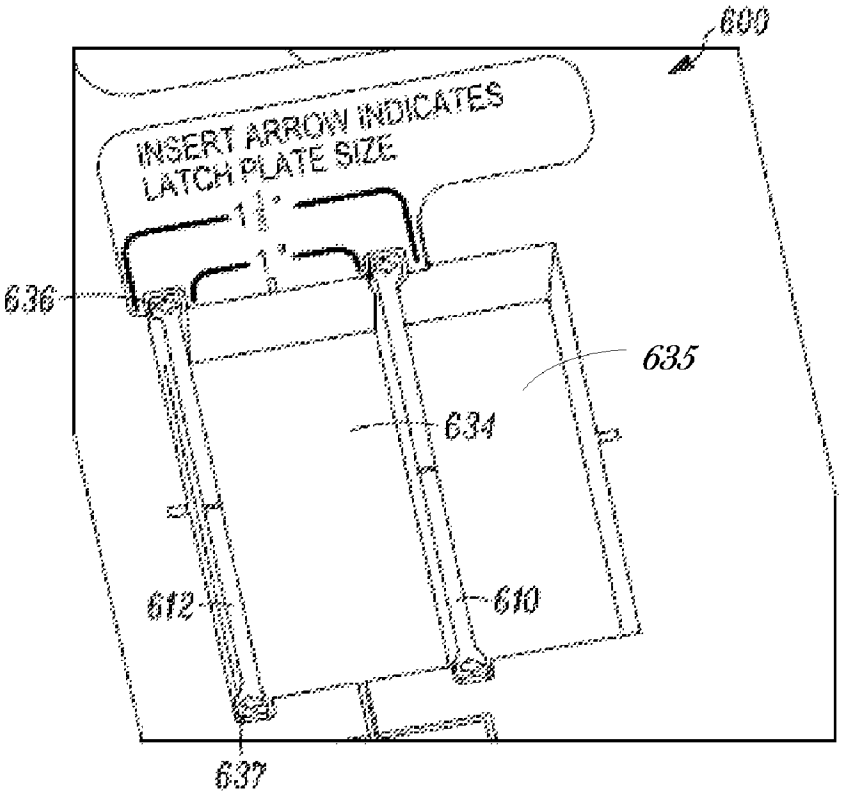
FIGS. 6A and 6B are schematic perspective views of a latch plate template having side wall inserts in different positions for cutting mortises for latch plates shown in FIGS. 4A and 4B.
Figure 6A:
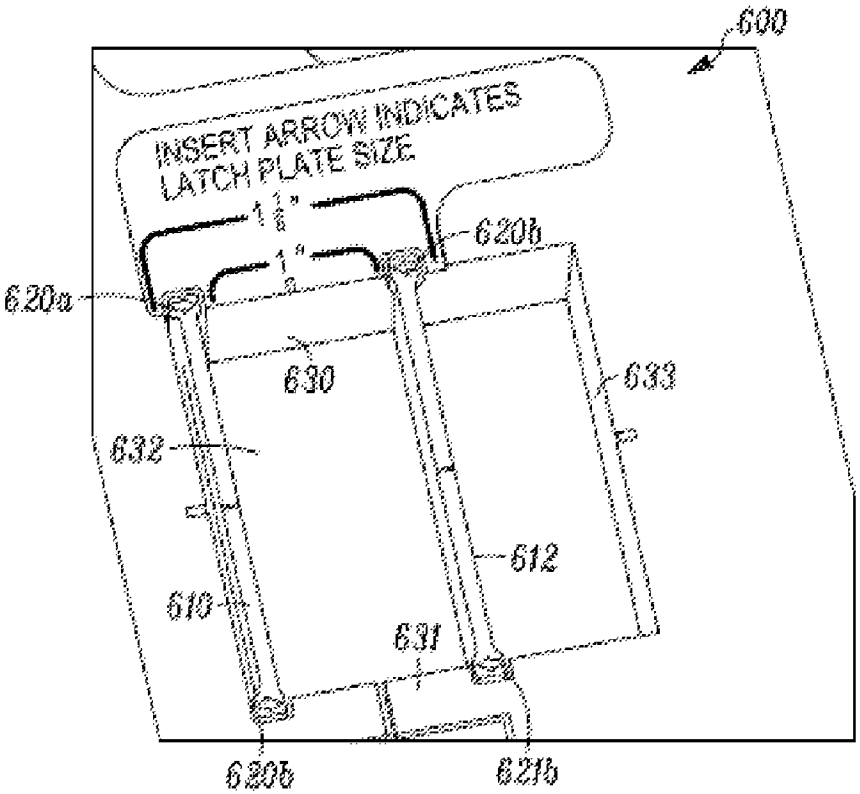

Another example of how inserts can be used to define multiple different sizes of template opening is shown in FIGS. 6A and 6B, which are schematic perspective views of a latch plate template having an opening into which two removable inserts can be inserted to vary the size of the opening. As shown in FIGS. 6A and 6B, the template includes elongated side wall inserts 610 and 612 that can be placed in different positions with respect to the body 600 of the template and used for cutting mortises for the latch plates shown in FIGS. 4A and 4B. Opening 632, 634, and 635 in template can have lengths that can be defined by the distance between a top end wall 630 and a bottom end wall 631, and widths that can be defined by the distance between side walls 633, between a side wall and an a side wall insert 610 or 612, or between two side wall inserts 610 and 612.

The body 600 includes recesses 620 and 621 in portions of the body that define a top end wall 630 and a bottom end wall 631 of the opening 632 or 634 in the template (where reference to recesses 620 (without an alphabetical suffix) refers to the pair or recesses 620*a* and 620*b*, and where reference to recesses 621 (without an alphabetical suffix) refers to the pair or recesses 621*a* and 621*b*). In the implementation shown in FIGS. 6A and 6B, the body can include a first pair or recesses 620*a* and 620*b* in the body at the top wall 630 and the bottom wall 631, respectively for receiving a side wall insert 610, and a second pair or recesses 621*a* and 621*b* in the body at the top wall 630 and the bottom wall 631, respectively for receiving a side wall insert 612. The recesses 620 and 621 can receive tabs 636 and 637 located at top and bottom ends of the inserts and thereby locate the inserts in the body 600 of the template. When a pair of inserts 610 and 612 is so located in the body, surfaces of the two inserts that face each other may define a width of an opening in the template that can be used to guide a router that cuts a mortise.

The tabs 636 of the inserts 610 and 612 are offset from a central plane that runs along a central longitudinal axis of the inserts. Therefore, when an insert 610 is positioned by the engagement of recesses 620 with offset tabs 636, the axis of the insert is not aligned with a line between the centers of the recesses, but rather is laterally offset from such a line. An insert 610 can be offset toward its opposing insert 612 or can be offset away from its opposing insert. As shown in FIG. 6A, when marking arrows on opposing inserts 610 and 612 point toward each other, the inserts are offset toward each other and the width of the opening 632 is relatively narrow. For example, the width of the opening may be 1.125 inches, such that the opening can be used to cut a 1.000 inch wide mortise for use with a standard sized latch plate 602. When the inserts 610 and 612 are placed in the recesses 620 and 621 such that they are offset towards each other and define a relatively narrow opening 632, marking arrows on the inserts 610 and 612 can point toward a dimension marking on the top surface of the template (e.g., the 1" marking shown in FIG. 6A) that designates the width of the mortise that is cut when the inserts are so positioned.

As shown in FIG. 6B, when marking arrows on opposing inserts 610 and 612 point away from each other, the inserts are offset away from each other and the width of the opening 634 is relatively broad. For example, the width of the opening may be 1.250 inches, such that the opening can be used to cut a 1.125 inch wide mortise for use with the latch plate 604. When the inserts 610 and 612 are placed in the recesses 620 and 621 such that they are offset away each other and define a relatively wide opening 434, marking arrows can point toward a dimension marking on the top surface of the template (e.g., the 1⅛" marking shown in FIG. 6B) that designates the width of the mortise that is cut when the inserts are so positioned. If the insets 610 and 612 are oriented with their arrow indicators both pointing in the same direction, then the opening would be 1.1875 inches wide and could be used to be cut a 1.0625 inch wide mortise.

The configuration of shown in FIG. 6A, in which the inserts are offset towards each other and the width of the opening 632 is relatively narrow can be converted to the configuration shown in FIG. 6B in which the inserts are offset away from each other and the opening 634 has a relatively wide width in several ways. For example, each insert can be removed from the recesses into which it is inserted and rotated 180 degrees, so that top ends of the inserts that formerly engaged with recesses 620*a* and 621*a* are engaged with recesses 620*b* and 621*b*. In another example, each insert can be removed from the recesses into which it is inserted and moved without rotation to the recesses into which the other insert was formerly engaged, i.e., the positions of inserts 610 ad 612 can be swapped, as shown by comparing FIG. 6A and FIG. 6B.

When both inserts are removed from the body then the width of the an opening 632 or 634 takes on an even larger width.

Figure 6C:
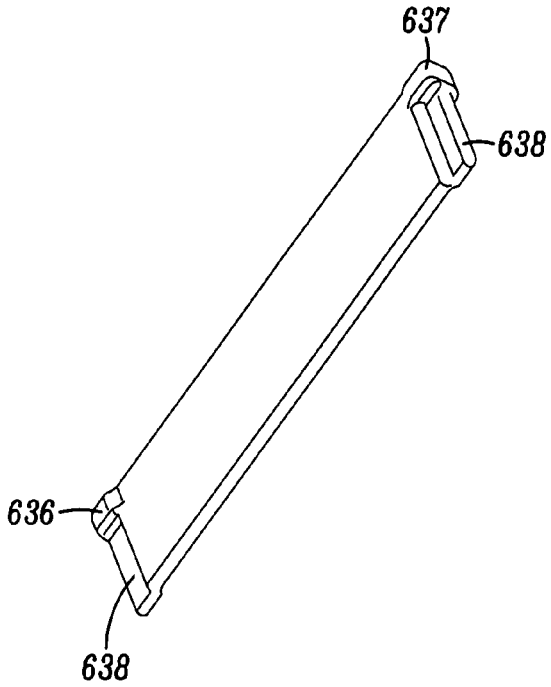
FIGS. 6C and 6D are first and second perspective views of a side wall insert of FIGS. 6A and 6B.
Figure 6D:
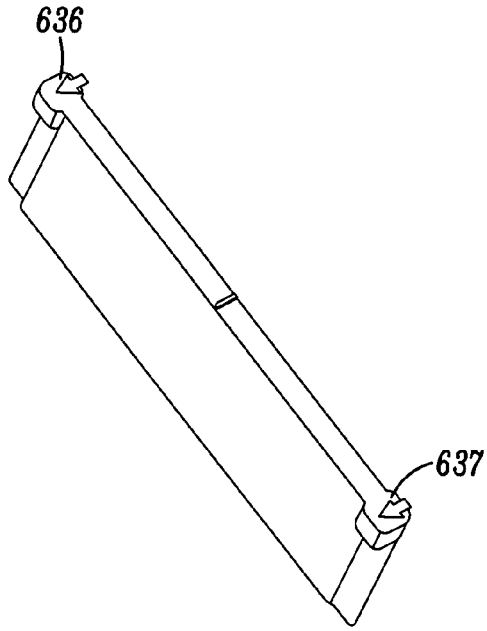
Figure 6E:
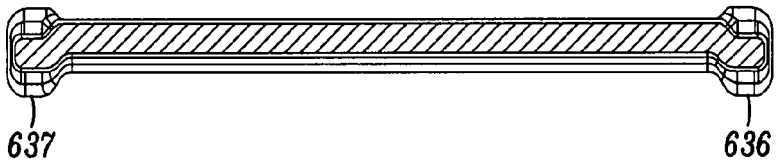
FIG. 6E is a schematic bottom sectional view of a side wall insert.

FIG. 6C is a first perspective view of a side wall insert 610 looking up from the bottom of the insert, and FIG. 6D is a second perspective view of the side wall insert looking down from the top of the insert. FIG. 6E is a schematic bottom sectional view of a side wall insert. Offset tabs 636 are shown at both ends of the insert, and below each offset tab is an offset vertical member 638 that can slide into a vertical recess 620 in the end wall of the body of the template to locate the insert in the body. Offset tab 636 and vertical member 638 may also be perceived as an offset flange at either end of what would otherwise be a rectangular slab-shaped insert.

Referring again to FIGS. 6A and 6B, the width of the opening in the template 600 can be selected depending on the position and/or orientation of the inserts. Thus, when inset 410 is located to the left of inset 412, as shown in FIG. 6A, the width of the opening 432 is relatively narrow, but when the positions of the inserts 410 and 412 are swapped, and insert 410 is located to the right of insert 412, as shown in FIG. 4D, the width of the opening 434 is relatively wide.

Figure 7:
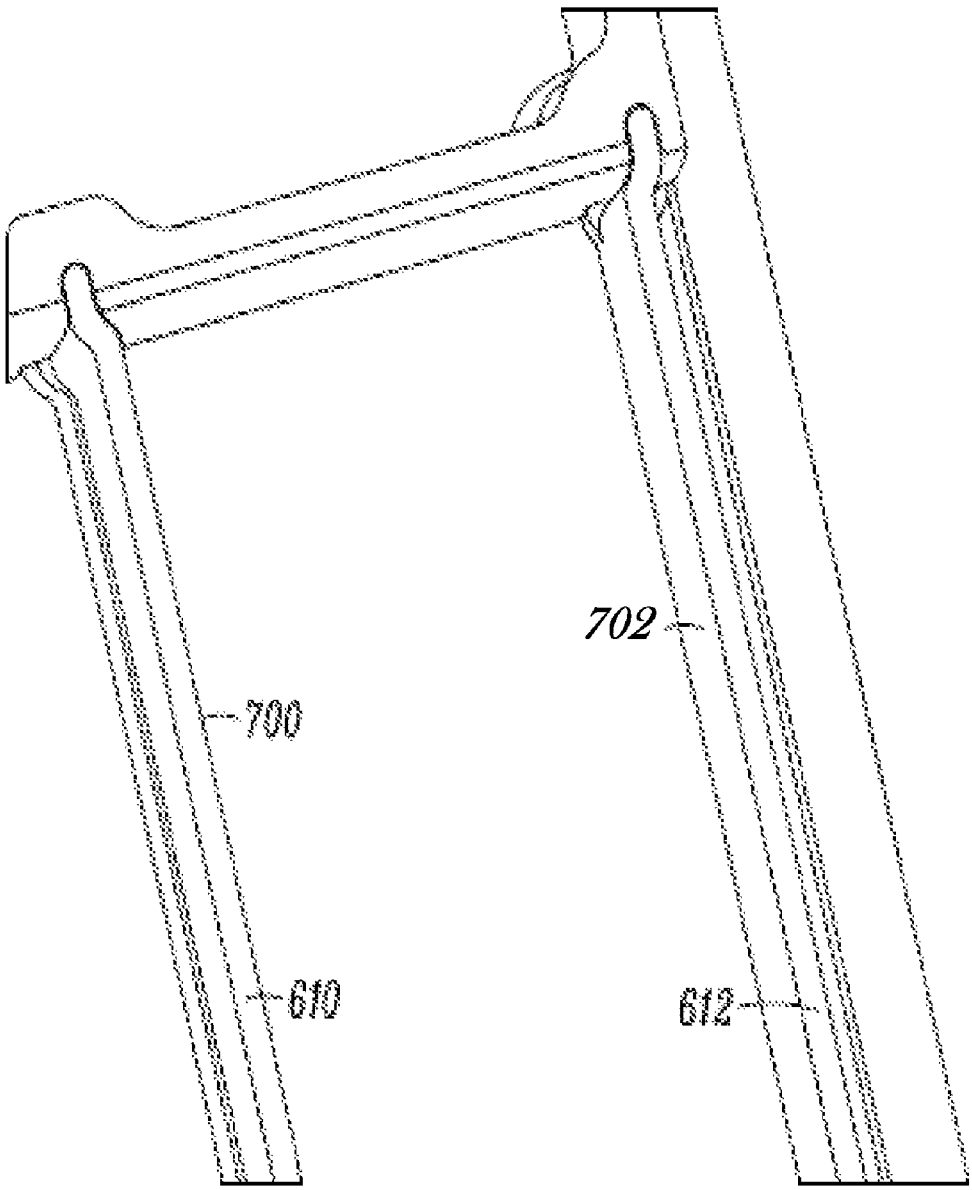
FIG. 7 is a schematic perspective bottom view of the latch plate template and side wall inserts of FIG. 6A.

FIG. 7 is a schematic perspective bottom view of the latch plate template of FIG. 6A. The inserts 610 and 612 are positioned such that a surface 700 of insert 610 faces a surface 702 of opposing insert 612 and the distance between the surfaces 700 and 702 defines a relatively narrow width of the opening in the template. In this position both surfaces 700 and 702 face inward toward the opening. If the inserts were repositioned, such that surfaces 700 and 702 faced outward away from each other and away from the opening in the template, then the width of the opening would be relatively wide.

Referring again to FIGS. 6A and 6B, it should be appreciated that if insert 612 in FIG. 6A is removed entirely, or if insert 610 in FIG. 6B is removed entirely, then an opening with an extra-wide width may be defined by the body 600 of the template and the remaining insert (e.g., insert 610 in FIG. 6A and insert 612 in FIG. 6B). An opening with such an extra-wide width can be used to define a pattern for a strike plate mortise to be cut into a jamb and used to position a wide strike plate in the mortise of the jamb.

Figure 8A:
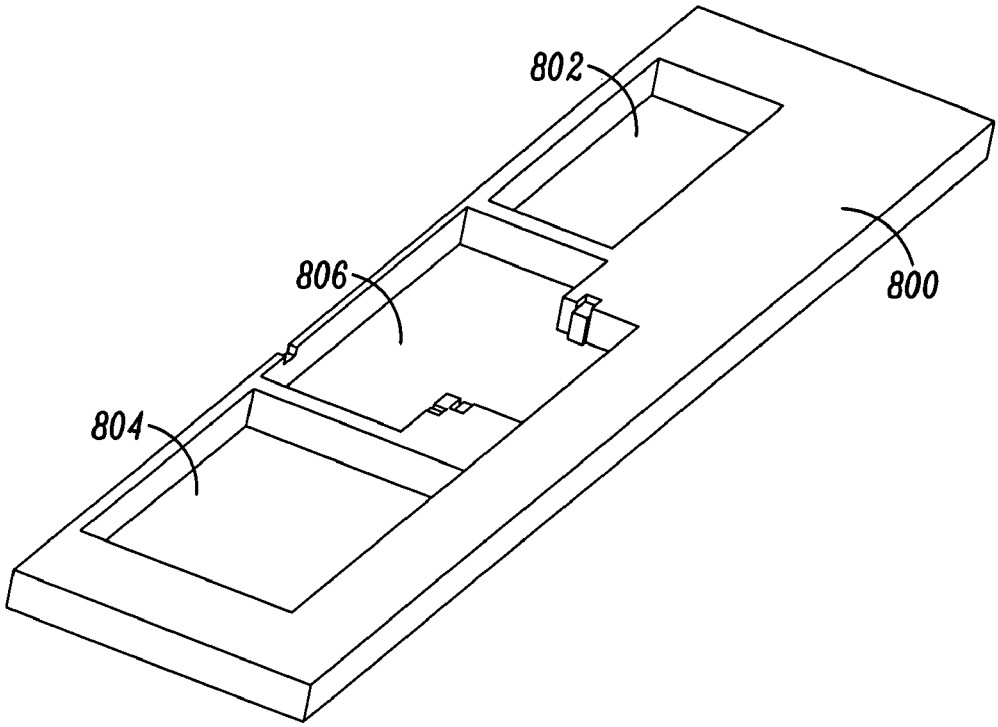
FIGS. 8A and 8B are schematic perspective views of a three-opening template that can be used to make seven different-sized mortise patterns.
Figure 8B:
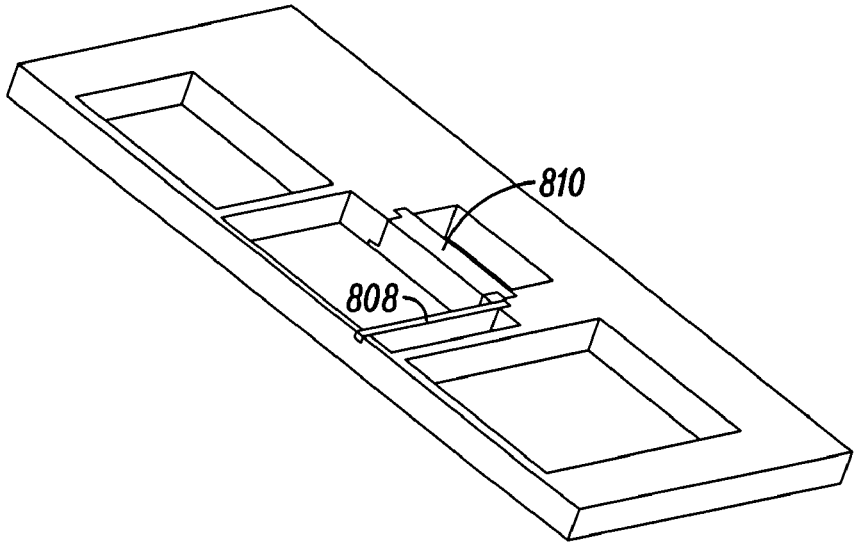

FIGS. 8A and 8B are schematic perspective views of a three-opening template that can be used to make six different-sized mortise patterns. A first opening 802 can be defined by the template body 800 to have a predetermined length and width. For example, the length and width can correspond to those used to cut a mortise for a latch plate of a particular size and shape (e.g., 1 inch×2.375 inches). A second opening 804 also can be defined by the template body 800 to have a predetermined length and width. For example, the length and width can correspond to those used to cut a mortise for a strike plate of a particular size and shape (e.g., 2.25 inches×1.75 inches or more (if the strike plate extends off the edge of the door jamb)). A third opening 806 can be defined by the template body 800 to have a predetermined length and width and shape. For example, the shape can be that corresponding to a "T" shaped strike plate having a tongue that extends off the jamb and a length of 2.75 inches. The perimeter walls of the opening 806 can include recesses or other couplings for engaging with removably-engagable gates that can be used to redefine the size and shape of the opening 806. For example, as shown in FIG. 8B, insertion of an end gate 808 can shorten the length of the opening 806 (e.g., to a length corresponding to a strike or latch plate length of 2.25 inches). Similarly, insertion of a side gate 810 can change the shape of the opening 806 from "T" shaped to rectangular, and can define the width of the opening to be used to create a mortise for use with a 1.125 inch wide latch plate.

Figure 9A:
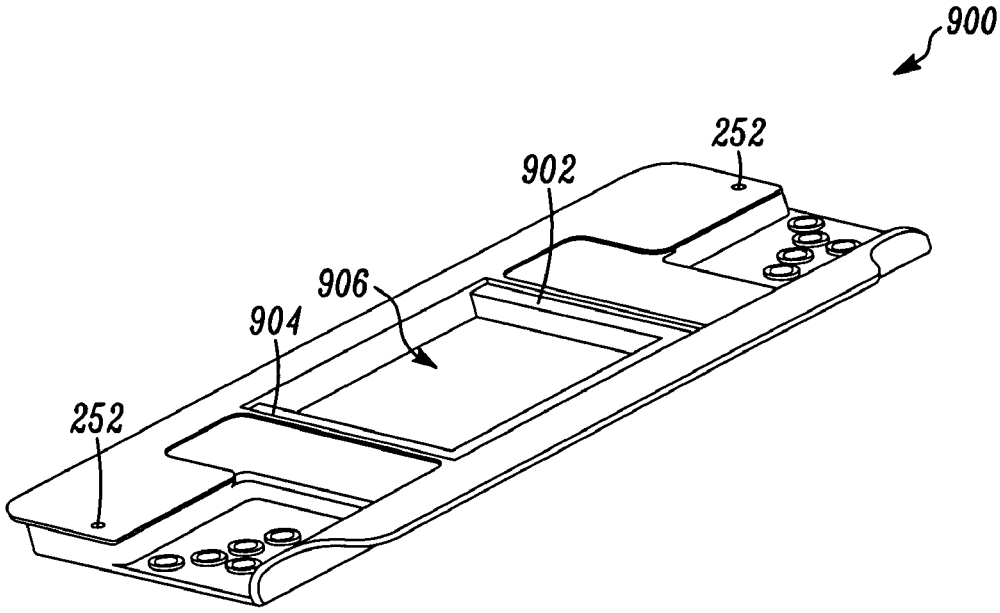
FIGS. 9A and 9B are a schematic perspective views of a single-opening template that can be used in conjunction with multiple inserts to define different-sized and shaped openings to create various sized and shaped mortises.
Figure 9B:
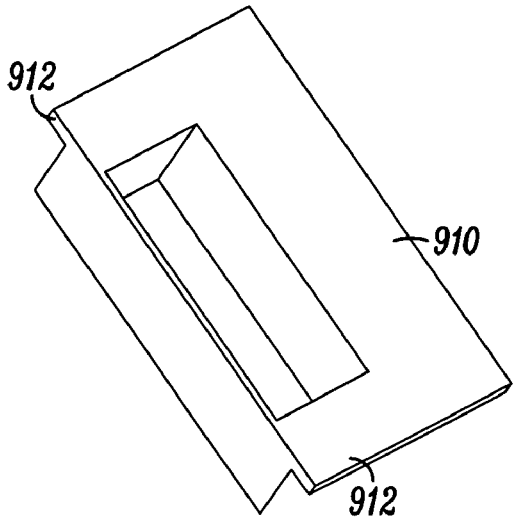
Figure 10A:
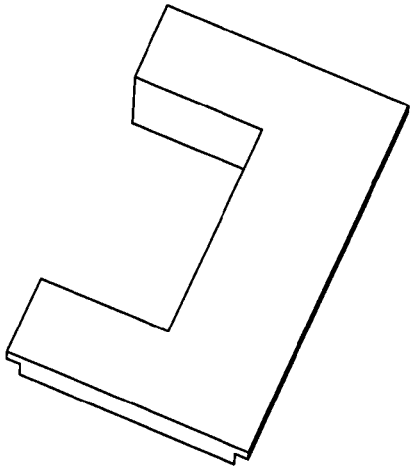
FIGS. 10A, 10B, 10C, and 10D are schematic perspective views of template inserts that can be used with a base member to define openings that have various different shapes and sizes.
Figure 10B:
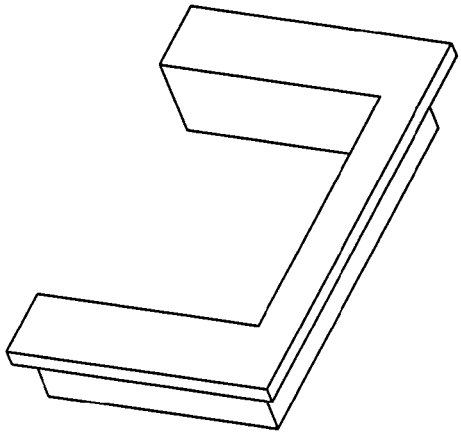
Figure 10C:
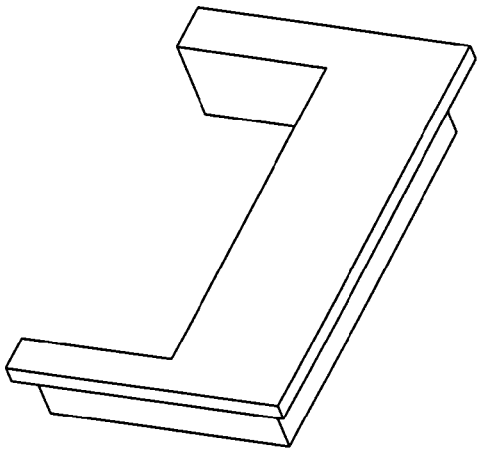
Figure 10D:
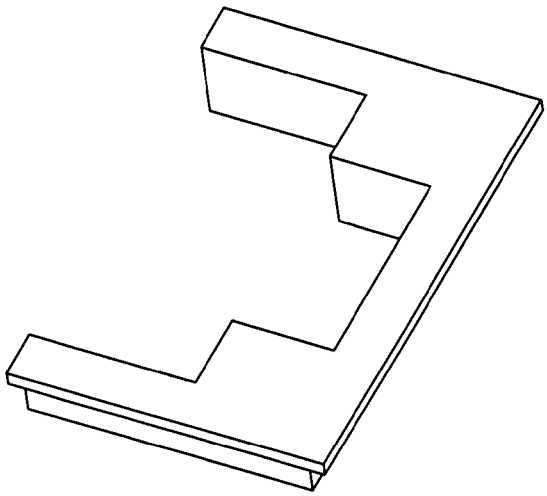

FIGS. 9A and 9B are schematic perspective views of a single-opening template 900 that can be used in conjunction with multiple inserts to define different-sized and shaped openings to create various sized and shaped mortises. The template can include a base member 902 that includes a large opening 906. Edges of opening 906 can include first engagement members (e.g., ledges 904) that can receive an insertable window member 910 that defines an opening of a size and shape that can be used to cut a mortise having a predetermined size and shape in a door or in a door jamb. For example, the window member 910 can include flange sections 912 that engage with the ledges 904 of the base member to locate the window member 910 in the base member. Of course, other window members having different shapes and sizes (e.g., shown in FIGS. 10A, 10B, 10C, and 10D) can be used with the base member 900 to define openings that have other shapes and sizes.

Figure 11:
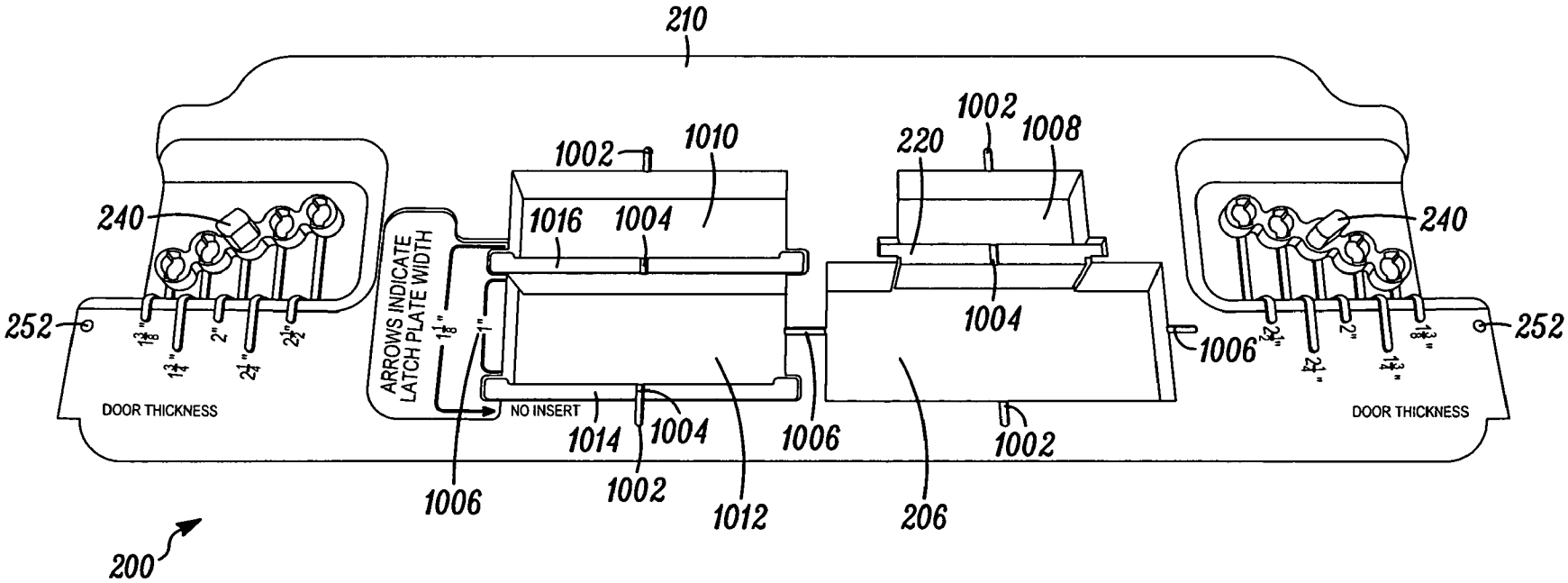
FIG. 11 is a schematic perspective view of a latch and strike plate template having centering marks on openings in the template.

FIG. 11 is a schematic perspective view of a latch and strike plate template having centering marks on openings in the template. Vertical centering marks 1002 can be scribed, molded, painted or otherwise placed on the template 200 at the vertical midpoint of openings 206, 1008, 1010, and 1012. Similarly, vertical centering marks 1004 can be scribed, molded, painted, or otherwise placed on the inserts 220, 1014, and 1016 that can be dropped into the template 200, such that when the inserts are dropped into the template the vertical centering marks are at the vertical midpoint of openings 206, 1008, 1010, and 1012. The centering marks can be used by a user who wants to position the mortise for the strike or latch plate in a predetermined position on the door jamb or door. For example, the user could draw a vertical line on the doorjamb where he wants the center of the strike plate mortise to be cut. Then, to accurately position the template, the user can place the vertical centering marks 1002 of a desired opening over the line on the door jamb drawn by the user. The centering marks 1002 also can be used to check if the template has moved from its desired position by comparing the position of the centering marks with the line drawn by the user on the doorjamb. In another example, a lock may be inserted in a door that is hung on a door frame and the centering mark can be used to properly position a strike plate in the door jamb. The door can be swung so that the bolt of the lock is close to or touching the door jamb and a line can be scribed on the jamb at a position corresponding to the center of the bolt. Then the template can be positioned so that a centering mark 1002 is aligned with the scribed line and the mortise for the strike plate can be cut with the template in this position.

Horizontal centering marks 1006 can be scribed, molded, painted, or otherwise placed on the template 200 at the horizontal midpoint of openings 206, 1008, 1010, and 1012. Similarly, horizontal centering marks could be scribed, molded, painted, or otherwise place, on the inserts 220, 1014, and 1016 that can be dropped into the template 200, such that when the inserts are dropped into the template the horizontal centering marks would be at the vertical midpoint of openings 206, 1008, 1010, and 1012. Like the vertical centering marks, the horizontal centering marks can be used by a used who wants to position the mortise for the strike or latch plate in a predetermined position on the door jamb or door.

Figure 12A:
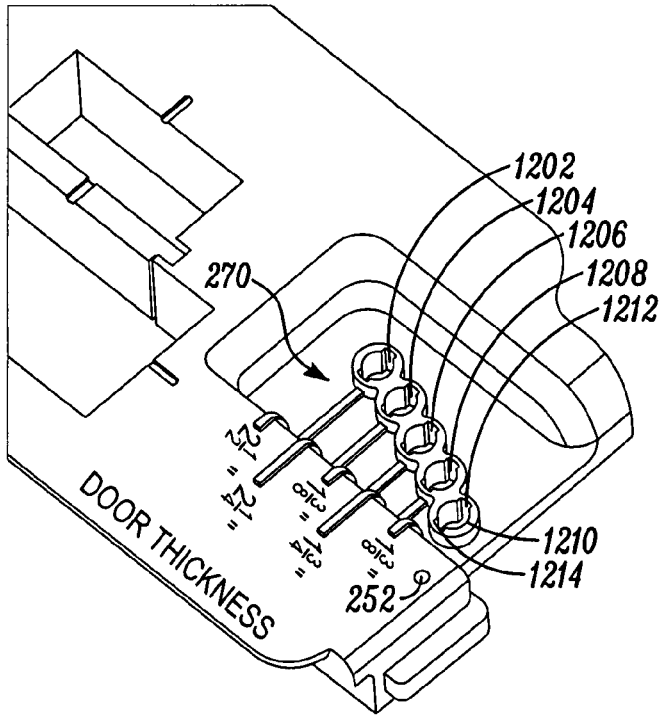
FIG. 12A is an schematic perspective view of an end of a latch and strike plate template having opening holes for receiving a locating pin.
Figure 12B:
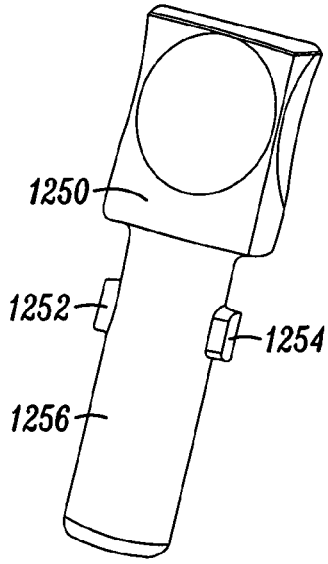
FIG. 12B is a schematic perspective a locating pin to hold the latch and strike plate template of FIG. 12A in place.

FIG. 12A is a schematic perspective view of an end of a latch and strike plate template 200 that include the alignment portion of the template and that has opening apertures 1202, 1204, 1206, 1208, and 1210 for receiving a locating pin 1212. FIG. 12B is a schematic perspective a locating pin 1250 that can be inserted into one of the opening holes of the latch and strike plate template of FIG. 12A in place to position the latch and strike plate template precisely against a door (e.g., as shown in FIG. 2B). The opening apertures 1202, 1204, 1206, 1208, and 1210 in the latch and strike plate template are generally circular but have slots 1214 and 1216 for receiving tabs 1252 and 1254 on the shaft 1256 of the locating pin 1250. As shown in FIG. 12B, the tabs are located 180 degrees opposite each other on the pin, but other positions or numbers of tabs on a pin are also possible. The tabs 1252 and 1254 and slots 1214 and 1216 allow the pin 1250 to be locked into an opening aperture 1202, 1204, 1206, 1208, or 1210, so that the pin does not accidentally fall out of the hole during use. Adjacent to each opening aperture 1202, 1204, 1206, 1208, or 1210 is a dimension that corresponds to a door thickness with which the template can be used. When the pins are inserted into a set of pins that correspond to a particular door thickness and the template is used to cut a mortise in such a door, the template can be used to cut a mortise in an edged surface of the door midway between a front and back surface of the door.

Figure 13A:
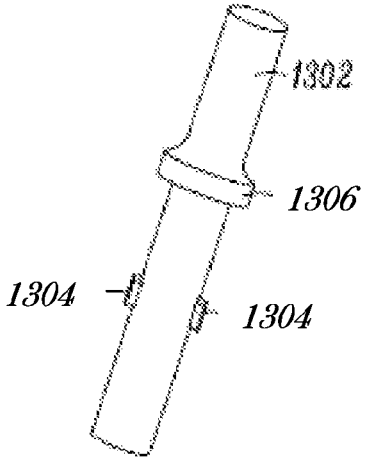
FIG. 13A is a schematic perspective a locating pin to hold the latch and strike plate template of FIG. 12A in place.

FIG. 13A is a schematic perspective view of a locating pin 1302 similar to the locating pin 1250 that can be locked into an opening hole of the template 200. The pin 1302 has a nominal diameter and tabs 1304 that protrude radially from the pin to locally increase the diameter of the pin. The pin 1302 also has a collar 1306 that locally increases the diameter of the pin.

Figure 13B:
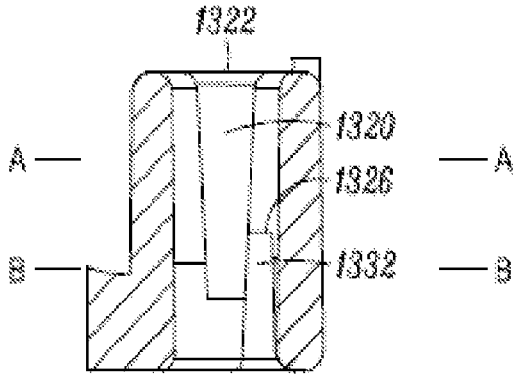
FIG. 13B is a cross-sectional view of an opening hole in a latch and strike plate template for receiving the locating pin of FIG. 13A.
Figure 13C:
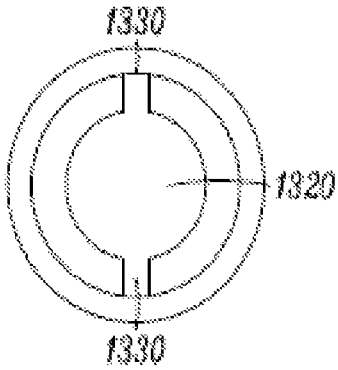
FIG. 13C is a cross-sectional view of the opening hole of FIG. 13B through the line A-A in FIG. 13B.
Figure 13D:
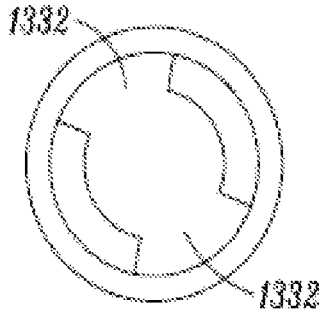
FIG. 13D is a cross-sectional view of the opening hole of FIG. 13B through the line B-B in FIG. 13B.

FIG. 13B is a cross-sectional view of an opening hole 1320 in a latch and strike plate template for receiving the locating pin 1302 of FIG. 13A. FIG. 13C is a cross-sectional view of the opening hole of FIG. 13B through the line A-A in FIG. 13B. FIG. 13D is a cross-sectional view of the opening hole of FIG. 13B through the line B-B in FIG. 13B. The opening hole 1320 has a nominal diameter that is slightly smaller than the nominal diameter of the pin 1302, so that the pin can fit easily but not loosely into the opening hole. The opening hole also has a top surface 1322 that cooperates with the collar 1306 of the pin to prevent the pin 1302 from being inserted into the opening hole beyond a predetermined depth.

The pin 1302 can be inserted into the opening hole 1320 by aligning the tabs 1304 with radial slots 1330 in the hole, and then the pin can be inserted to a depth determined by the distance from the collar 1306 to the bottom of the pin. When the pin has reached this depth, the pin 1302 can by rotated so that the tabs 1304 are each rotated in a channel 1332 within the opening hole 1320. After insertion and rotation, the tabs 1304 are positioned under a top surface 1326 of the channel 1332 that prevents the tab 1304, and therefore the entire pin 1302, from moving upward. Thus, the pin 1302 cannot accidentally fall out of the opening hole after it has been inserted and rotated within the opening hole 1320. The top surface 1326 of the channel can slope downward in the azimuthal direction (i.e., around the circumference of the channel), such that the top of the tabs engages progressively tighter with the top surface 1326 as the pin 1302 is rotated, causing the pin to be locked in place.

Many other features and advantages of the latch and strike plate template 200, not discussed explicitly herein, may be provided. For example, the template 200 may be made of metal (e.g., steel), or may be made of molded plastic, or other suitable material. The template may be used to define and cut mortises in doors, door jambs, windows, and window jambs (generically, "passageways").

While certain features of the described implementations have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A lock template comprising:

a body member defining a substantially rectangular first opening having a top wall, a bottom wall, and side walls and having a first length between the top wall and the bottom wall and a first width between the first and second side walls, wherein the top wall and the bottom wall include opposing first end recesses; and an elongated first insert member configured to be removably-inserted into the first end recesses such that the elongated first insert member is located at least partially within the first opening, wherein the elongated first insert member, when inserted in the first end recesses, defines a wall that is substantially parallel to the first side wall of the first opening and a substantially rectangular second opening is defined between the top wall and the bottom wall and between the first side wall and the wall defined by the elongated first insert member, the substantially rectangular second opening having a length between the top wall and the bottom wall substantially equal to the first length and a second width between the first side wall and the wall defined by the elongated first insert member, the second width being smaller than the first width, wherein when the elongated first insert member is inserted into the first end recesses the wall defined by the elongated first member is substantially parallel to, but perpendicularly offset from a plane containing the first end recesses in a direction away from the first side wall, wherein the second opening is configured to guide a cutting instrument to form a mortise for a lock component in a passageway component; and wherein the body includes at least one alignment portion having a plurality of apertures configured to receive an alignment pin, wherein locations of the plurality of apertures on the body correspond to a plurality of door thicknesses; and wherein the body includes an alignment surface that is configured to abut against a surface of the passageway component when cutting into the passageway component.

2. The lock template of claim 1, wherein when the elongated first insert member inserted into the first end recesses of the body in a first position the wall of the second opening defines the second width of the second opening, and wherein when the elongated first insert member is inserted into the first end recesses in a second position the wall defined by the elongated first member is substantially parallel to, but perpendicularly offset from the plane containing the first end recesses in a direction toward the first side wall, and wherein when the elongated first insert member is inserted in the first end recesses in the second position a substantially rectangular third opening is defined between the top wall and the bottom wall and between the first side wall and the wall defined by the elongated first insert member, the substantially rectangular third opening having a length between the top wall and the bottom wall substantially equal to the first length and a third width between the first side wall and the wall defined by the elongated first insert member, the third width being less than the second width.

3. The lock template of claim 2, wherein in the first position a top end of the elongated first insert member is inserted into a recess in the top wall and a bottom end of the elongated first insert member is inserted into a recess in the bottom wall, and wherein in the second position the top end of the elongated first insert member is inserted into the recess in the bottom wall and the bottom end of the elongated first insert member is inserted into the recess in the top wall.

4. The lock template of claim 2, wherein the body includes a top surface upon which dimensions corresponding to the second and third width are indicated, and wherein the elongated first insert member includes an indication that refers to the dimension of the second width when located in the first position and that refers to the dimension of the third width when located in the second position.

5. The lock template of claim 1, wherein the top wall and the bottom wall include opposing second end recesses, the opposing second end recesses being located in a plane substantially parallel to a plane containing the opposing first end recesses, the template further comprising:

an elongated second insert member configured to be removably-inserted into the second end recesses such that the elongated second insert member is located at least partially within the first opening, wherein the elongated second insert member, when inserted in the second end recesses, defines a wall that is substantially parallel to the first side wall of the first opening located between the first side wall and the wall defined by the elongated first insert member when the elongated first insert member is inserted in the first end recesses.

6. The lock template of claim 1, wherein a selected one of the plurality of apertures is configured to receive the alignment pin therethrough, and wherein the alignment pin extends beyond the alignment surface when the alignment surface abuts the surface of the passageway component, and wherein the alignment pin abuts against the passageway during formation of the mortise in the passageway component.

7. The lock template of claim 1, wherein:

the alignment pin includes a plurality of radially-extending tabs, the plurality of apertures each include a corresponding plurality of slots to receive the plurality of tabs, and the plurality of slots each include an internal surface, further wherein the alignment pin is configured for locking into place within a selected one of the plurality of apertures by insertion of the tabs into the corresponding slots and subsequent rotation of the alignment pin to thereby position the tabs within the slot and in contact with the internal surface.

8. The lock template of claim 1, wherein the body includes a plurality of indicia associated with the plurality of apertures, each of the indicia specifying a door thickness associated with the associated aperture.

9. The lock template of claim 1, wherein the body includes a center line marking positioned to designate a midpoint along the length of the first opening.

10. A lock template comprising:

a body having a substantially "T"-shaped first opening, the first opening having a substantially rectangular stem portion and a substantially rectangular cross portion continuously connected to the stem portion, the stem portion having a stem width and a stem length, the cross portion having a cross length and a cross width, a longitudinal axis along the length of the stem portion being substantially perpendicular to a longitudinal axis along the length of the cross portion the opening being configured to guide a cutting instrument to form a mortise for a lock component in a passageway component;

a side gate adapted to be removably coupled to the body at least partially within the first opening to define a first wall separating the stem portion and the cross portion, the first wall thereby defining a substantially rectangular second opening having a having a length equal to the cross length and a width equal to the cross width; and an end gate adapted to be removably coupled to the body to define a second wall within the cross portion of the first opening, the second wall being substantially perpendicular to the first wall, the first and second walls thereby defining a substantially rectangular third opening having a length less than the cross length and a width equal to the cross width.

11. The lock template of claim 10, wherein the first opening is adapted to form a mortise for a strike plate having a tongue when the first insert is removed from the body and wherein the second opening is adapted to form a mortise without a tongue when the side gate is coupled to the body.

12. The lock template of claim 10, wherein the body includes at least one alignment portion having a plurality of apertures configured to receive an alignment pin, wherein locations of the plurality of apertures on the body correspond to a plurality of door thicknesses; and wherein the body includes an alignment surface is configured to abut against a surface of the passageway component when forming the mortise in the passageway component.

13. The lock template of claim 12, wherein a selected one of the plurality of apertures is configured to receive the alignment pin therethrough, and wherein the alignment pin extends beyond the alignment surface when the alignment surface abuts the surface of the passageway component.

14. The lock template of claim 12, wherein a selected one of the plurality of apertures is configured to receive the alignment pin therethrough, and wherein the alignment pin abuts against the passageway component during formation of the mortise in the passageway component.

15. The lock template of claim 12, wherein:

the alignment pin includes a plurality of radially-extending tabs, the plurality of apertures each include a corresponding plurality of slots to receive the plurality of tabs, and the plurality of slots each include an internal surface, further wherein the alignment pin is configured for locking into place within a selected one of the plurality of apertures by insertion of the tabs into the corresponding slots and subsequent rotation of the alignment pin to thereby position the tabs within the slot and in contact with the internal surface.

16. A lock template comprising:

a body member defining a baseline opening having a top wall and a bottom wall and having a first length between the top wall and the bottom wall, wherein the top wall and the bottom wall include opposing first end recesses and opposing second end recesses, the opposing second end recesses being located in a plane substantially parallel to a plane containing the opposing first end recesses;

an elongated first insert member configured to be removably-inserted into the opposing first end recesses such that the elongated first insert member is located at least partially within the baseline opening;

an elongated second insert member configured to be removably-inserted into the second end recesses such that the elongated second insert member is located at least partially within the baseline opening, wherein the elongated first and second insert members, when inserted in their respective first and second end recesses in respective first positions, define respective first and second walls that are substantially parallel to each other to define a substantially rectangular first opening having a first width between the first and second walls and a length between the top and bottom walls, the first wall being substantially parallel to and laterally offset from a plane containing the first end recesses in a direction toward a plane containing the second end recesses, the second wall being substantially parallel to and laterally offset from a plane containing the second end recesses in a direction toward a plane containing the first end recesses, wherein the elongated first and second insert members, when inserted in the respective first and second end recesses in respective second positions, define respective first and second walls that are substantially parallel to each other to define a substantially rectangular second opening having a second width, greater than the first width, between the first and second walls and a length between the top and bottom walls, the first wall being substantially parallel to and laterally offset from a plane containing the first end recesses in a direction away from a plane containing the second end recesses, the second wall being substantially parallel to and laterally offset from a plane containing the second end recesses in a direction away from a plane containing the first end recesses, and wherein the second opening is configured to guide a cutting instrument to form a mortise for a lock component in a passageway component.

17. The lock template of claim 16, wherein the body includes at least one alignment portion having a plurality of apertures configured to receive an alignment pin, wherein locations of the plurality of apertures on the body correspond to a plurality of door thicknesses; and wherein the body includes an alignment surface that is configured to abut against a surface of the passageway component when forming the mortise in the passageway component.

18. The lock template of claim 16, wherein, as compared with the first position of the elongated first insert member, when the elongated first insert member is in its second position, the elongated first insert member is rotated by approximately 180 degrees about an axis that runs between the top wall and the bottom wall in a plane that contains the opposing first end recesses, and wherein, as compared with the first position of the elongated second insert member, when the elongated second insert member is in its second position, the elongated second insert member is rotated by approximately 180 degrees about an axis that runs between the top wall and the bottom wall in a plane that contains the opposing second end recesses.

19. The lock template of claim 16, wherein, as compared with the first position of the elongated first insert member, when the elongated first insert member is in its second position, the elongated first insert member is rotated by approximately 180 degrees about an axis located in a plane substantially parallel to the top wall or the bottom wall and substantially at a midpoint between the opposing first end recesses, and wherein, as compared with the first position of the elongated second insert member, when the elongated second insert member is in its second position, the elongated second insert member is rotated by approximately 180 degrees about an axis located in a plane substantially parallel to the top wall or the bottom wall and substantially at a midpoint between the opposing second end recesses.

20. The lock template of claim 16, wherein the body includes a top surface upon which dimensions corresponding to the second and third width are indicated, and wherein the first and second members include indications that refer to the dimension of the second width when located in the first configuration and that refer to the dimension of the third width when located in the second configuration.

* * * * *